US009376799B2

(12) United States Patent
Ouellet

(10) Patent No.: US 9,376,799 B2
(45) Date of Patent: Jun. 28, 2016

(54) TRANSPORTABLE BUILDING AND FOUNDATION BEAMS THEREFOR

(71) Applicant: Martin Ouellet, Boucherville (CA)

(72) Inventor: Martin Ouellet, Boucherville (CA)

(73) Assignee: GESTION OUELLET DEMERS, INC, Varennes, Québec (CA)

( * ) Notice: Subject to any disclaimer, the term of this patent is extended or adjusted under 35 U.S.C. 154(b) by 0 days.

(21) Appl. No.: 14/758,243

(22) PCT Filed: Sep. 19, 2013

(86) PCT No.: PCT/CA2013/000792

§ 371 (c)(1),
(2) Date: Jun. 28, 2015

(87) PCT Pub. No.: WO2014/100888

PCT Pub. Date: Jul. 3, 2014

(65) Prior Publication Data

US 2015/0354198 A1 Dec. 10, 2015

Related U.S. Application Data

(60) Provisional application No. 61/746,657, filed on Dec. 28, 2012.

(51) Int. Cl.
*E04H 1/00* (2006.01)
*E04B 1/343* (2006.01)
(Continued)

(52) U.S. Cl.
CPC ..... *E04B 1/34321* (2013.01); *E02D 27/02* (2013.01); *E02D 27/32* (2013.01); *E02D 35/005* (2013.01); *E04B 1/344* (2013.01); *E04B 1/3447* (2013.01); *E04B 1/34368* (2013.01); *E04B 1/34384* (2013.01)

(58) Field of Classification Search
CPC ..... E04B 1/343; E04B 1/34321; E04B 1/344; E04B 1/34384; E04B 1/3447; E04B 1/34368; E02D 27/02; E02D 27/32; E02D 35/005
USPC ..... 52/79.5, 126.5, 126.6
See application file for complete search history.

(56) References Cited

U.S. PATENT DOCUMENTS 2,350,904 A 6/1944 King
2,751,635 A 6/1956 Donnahue
(Continued)

FOREIGN PATENT DOCUMENTS

CA 2649795 11/2007
CA 2726921 12/2009
(Continued)

*Primary Examiner* — Basil Katcheves
(74) *Attorney, Agent, or Firm* — Mario Theriault

(57) ABSTRACT

The transportable building is made of side-by-side building sections mounted on parallel foundation beams. Each building section has a skate clamp mounted thereto for sequential sliding and clamping engagements to one of two foundation beams. In another aspect, each of the beams has a removable receiving end attached thereto. Each receiving end has a V-shaped trough on an upper surface thereof to facilitate the alignment of building sections onto the foundation beams during the assembly of the transportable building. In yet another aspect, each foundation beam has workable jacks at each end thereof and a series of self-adjusting jacks mounted thereto between the workable jacks for supporting the transportable building on an uneven ground surface.

15 Claims, 5 Drawing Sheets

(51) Int. Cl.

| | |
|---|---|
| ***E04B 1/344*** | (2006.01) |
| ***E02D 27/02*** | (2006.01) |
| ***E02D 27/32*** | (2006.01) |
| ***E02D 35/00*** | (2006.01) |

(56) References Cited

U.S. PATENT DOCUMENTS

| | | | | | |
|---|---|---|---|---|---|
| 3,348,344 | A | | 10/1967 | Donnahue | |
| 3,443,344 | A | | 5/1969 | Williams, Jr. | |
| 3,469,587 | A | * | 9/1969 | Folkes | E04H 3/165 135/119 |
| 3,475,872 | A | | 11/1969 | Suhr | |
| 3,530,623 | A | * | 9/1970 | Burton | E04C 3/40 135/122 |
| 3,712,006 | A | | 1/1973 | Bea | |
| 3,729,890 | A | * | 5/1973 | Yamamoto | B66C 7/00 104/246 |
| 4,092,992 | A | * | 6/1978 | Huddle | E04B 1/32 135/119 |
| 4,221,087 | A | | 9/1980 | Lowe | |
| 4,545,171 | A | | 10/1985 | Colvin | |
| 5,461,832 | A | | 10/1995 | Smith | |
| 5,546,972 | A | * | 8/1996 | Wardell | B60J 7/062 135/119 |
| 5,611,178 | A | * | 3/1997 | Aubert | E04H 9/12 109/1 S |
| 5,839,239 | A | * | 11/1998 | Jang | E04B 1/3511 254/93 R |
| 6,253,500 | B1 | | 7/2001 | Gyllenhammar | |
| 6,374,433 | B1 | * | 4/2002 | Gray | E04H 3/165 4/498 |
| 6,763,633 | B2 | | 7/2004 | Cote | |
| 6,968,653 | B2 | | 11/2005 | Stapleton, Jr. | |
| 7,290,372 | B2 | | 11/2007 | Aust et al. | |
| 7,841,136 | B2 | | 11/2010 | Czyznikiewicz | |
| 2010/0180404 | A1 | | 7/2010 | Chang | |

FOREIGN PATENT DOCUMENTS

| | | |
|---|---|---|
| GB | 1199959 | 7/1970 |
| JP | 2000-129789 | 7/2000 |
| JP | 2004-183363 | 7/2004 |

* cited by examiner

TRANSPORTABLE BUILDING AND FOUNDATION BEAMS THEREFOR

The present application claims the benefit of U.S. Provisional Application No. 61/746,657, filed Dec. 28, 2012.

FIELD OF THE INVENTION

This invention pertains to temporary buildings, and more particularly it pertains to modular buildings that can be transported in sections and erected and used on a building site for a period of time, and then taken down and away with minimum disturbance to the building site.

BACKGROUND OF THE INVENTION

Temporary buildings that are of interest herein are emergency shelters to be installed quickly as part of relief efforts in response to natural disasters such as earthquakes, tsunamis and tornadoes for examples. Other applications include buildings to be used as shelters, kitchens and hospitals in cities destroyed by war. Temporary buildings that are of interest herein also include buildings that are used for short-term industrial or warehousing purposes on preserved sites amidst the habitats of endangered species. This include all preserved natural sites where traces of human activities are to be erased at the completion of any industrial project.

These temporary buildings are normally built in sections in a metal fabrication shop. Each section is completed with its structural framework, insulation, outside cladding and roofing. Portions of the electrical wiring and plumbing are already mounted with connectors into the walls and ceiling of each section. Each section is folded in a compact mode and transported to the building site by trucks or by ships. These sections are erected by a crane, one section at the time, and connected to each other to form a complete building.

The advantages of these temporary buildings are numerous. They can be manufactured and stored for later use. They can be transported great distances and erected quickly as the need arises. When their uses are no longer needed, the buildings can be taken down and moved away without leaving a big footprint of their installations and uses.

The modular aspect of these buildings is characterized by the use of hinges, articulated braces, electrical and plumbing connectors, shackles and rails. Several documents have been found in the prior art describing folding buildings using hinges, connectors, articulated braces and rails. A good inventory of these documents describing modular transportable foldable buildings is included in the following documents.

U.S. Pat. No. 2,350,904 issued to T. E. King on Jun. 6, 1944;
U.S. Pat. No. 2,751,635 issued to T. C. Donnahue on Jun. 26, 1956;
U.S. Pat. No. 3,348,344 issued to L. Tatevossian on Oct. 24, 1967;
U.S. Pat. No. 3,443,344 issued to C. W. Williams, Jr., on May 13, 1969;
U.S. Pat. No. 3,475,872 issued to J. H. Suhr on Nov. 4, 1969;
U.S. Pat. No. 3,712,006 issued to Karl J. Bea on Jan. 23, 1973;
U.S. Pat. No. 4,221,087 issued to C. F. Lowe on Sep. 9, 1980;
U.S. Pat. No. 4,545,171 issued to Harry Colvin on Oct. 8, 1985;
U.S. Pat. No. 5,461,832 issued to G. A. Smith on Oct. 31, 1995;
U.S. Pat. No. 6,253,500 issued to T. Gyllenhammar on Jul. 3, 2001;
U.S. Pat. No. 6,763,633 issued to Roger Côte on Jul. 20, 2004;

U.S. Pat. No. 6,968,653 issued to J. A. Stapleton, Jr. et al., on Nov. 29, 2005;
U.S. Pat. No. 7,290,372 issued to Ingo Aust et al., on Nov. 6, 2007;
U.S. Pat. No. 7,841,136 issued to R. C. Czyznikiewicz on Nov. 20, 2010;
US Publication 2012/0180404 published by A. Scouten on Jul. 19, 2012;
JP 2004-183363 issued to Fukada Yoshinori on Jul. 2, 2004;
GB 1,199,959 issued to David Folkes Jul. 22, 1970.
CA Publication 2,649,795 published by R. M. Gibson on Nov. 15, 2007;
CA Publication 2,726,921 published by George Minko on Dec. 30, 2009.

Although the prior art is relatively fertile with suggestions about foldable buildings, there remain some inconveniences and disadvantages with the prior art configurations. For example, these buildings require excavation and levelling of a mounting surface with bulldozers, construction of a concrete floor including digging of foundation pads. Such activities are known for causing mud to leach into nearby streams, for releasing dust over fruit crops, and for destroying vegetation over a construction site that is three to four times the size of the building being built. Other disadvantages with foldable buildings of the prior art are the difficulties with the alignment of their sections with each other, and the weakness of the connections of these buildings to their foundations.

Therefore, there is a need in the field of portable buildings for a better concept for assembling and disassembling temporary buildings. More particularly, there is a need for a system for installing very large temporary buildings effectively without leaving significant damage to the building site.

SUMMARY OF THE INVENTION

In the present invention, there is provided a transportable building that is made of side-by-side building sections and parallel foundation beams. The mounting of each building section onto the foundation beams is done from one end of the beams such that the work area required during construction is limited to a relatively small space at that one end.

In one aspect of the present invention, each of the building sections has a roof and opposite vertical wall panels. Each vertical wall panel has a skate clamp mounted to the lower end thereof, for sequential sliding and clamping engagements to one of the foundation beams.

When a building section has been moved in place along the foundation beams, the skate clamps on the wall panels of that section are tightened to secure this building section to the foundation beams, to add ballast to the building section and to prevent a movement of this building section along the foundation beams.

In another aspect of the present invention, there is provided a pair of foundation beams for supporting the sides of a transportable building. Each of the foundation beams has a removable receiving end attached to an end thereof. Each receiving end has a V-shaped trough on an upper surface thereof. The V-shaped troughs are used to facilitate the alignment of building sections onto the foundation beams during the assembly of the transportable building.

In yet another aspect of the present invention, each foundation beam has workable jacks at each end thereof and a plurality of self-adjusting jacks mounted thereto between the workable jacks to support the transportable building on an uneven ground surface.

The transportable building according to the present invention is installed or uninstalled using a crane that remains stationary at one end of the building site. The ground surface under the building does not have to be levelled perfectly flat. There is no requirement for any concrete work to support this building. This building can be installed in a narrow space between existing buildings, on an abandoned roadbed or on a narrow wharf for example.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

A preferred embodiment of the present invention is illustrated in the accompanying drawings, in which like numerals denote like parts throughout the several views, and in which.

DESCRIPTION OF THE PREFERRED EMBODIMENT

Figure 1:
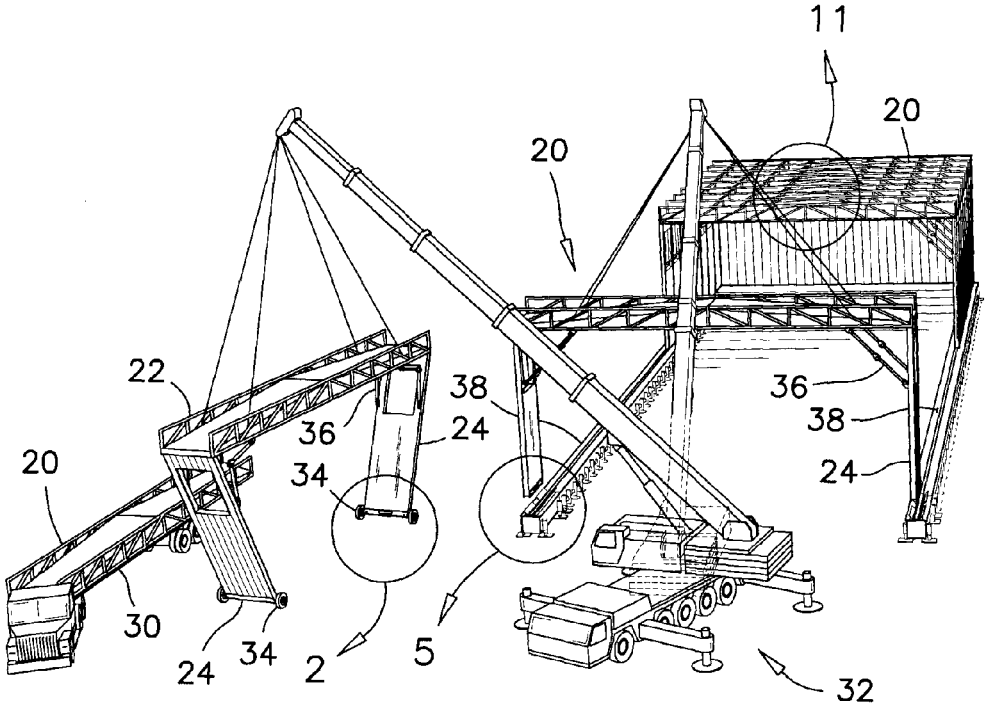
FIG. 1 is a perspective view of a building erection site illustrating the assembly of a transportable building according to the preferred embodiment of the present invention.

Referring firstly to FIG. 1, the installation of a transportable building according to the preferred embodiment of the present invention will be explained. For illustrative purposes, the building under construction in this drawing is 60 feet wide, 30 feet high and 160 feet long. Each section has a depth of 8 feet. As it will be appreciated, the transportable building according to the preferred embodiment of the present invention and the installation thereof are more compatible to very large buildings as opposed to residential constructions. The transportable building according to the preferred embodiment of the present invention also has a steel frame and metal outside cladding and roofing, although wood-frame constructions may also be used.

The transportable building according to the preferred embodiment of the present invention is built in sections 20 where each building section 20 has a roof portion 22 including roof trusses and wall panels 24 with windows in some or in all of the wall panels. Each building section 20 is transported to the building site by a transport truck 30. Two, three or more building sections 20 in their folded mode may be stacked on top of each other for delivery to the building site by transport truck 30. During transport, each building section 20 has its wall panels 24 folded toward each other under the roof portion 22.

Figure 2:
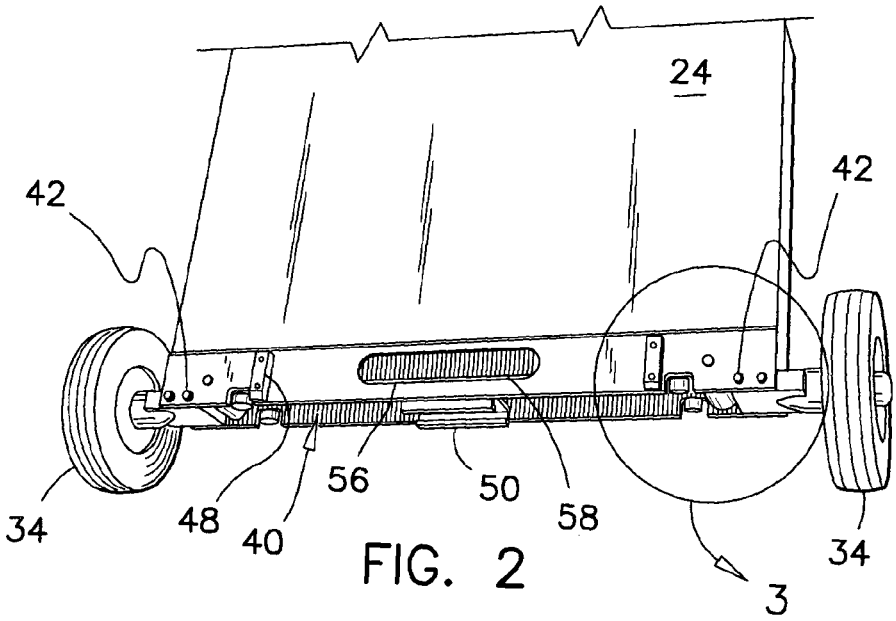
FIG. 2 is an enlarged view of the lower end of a wall panel in the building section being unloaded from a transport trailer in FIG. 1, as can be seen in detail circle 2 in FIG. 1.

Each building section 20 is deployed using a crane 32, by lifting the section off the ground while "rolling" the walls panels 24 into their deployed positions under the roof portion 22. Wheels 34 as are better illustrated in FIG. 2, are preferably temporary mounted to the bottom edge of each wall panel 24 to facilitate the deployment of the building section 20.

With the wheels 34 installed, a wall panel 24 is "rolled" into its deployed position while the roof portion 22 is being lifted by the crane 32. Once fully deployed, the wall panels 24 are secured at right angle to the roof portion 22 by articulated arms 36. The temporary wheels 34 can then be removed. Each building section 20 can be hoisted in place over a pair of parallel foundation beams 38.

In FIG. 1, the crane 32 is shown in a first orientation, pointing to the left, unloading and deploying a building section 20. In a second orientation, pointing away from the reader, the crane 32 is shown setting a building section 20 onto the foundation beams 38. Each building section 20 is then moved along the foundation beams 38 where it can be joined to a previously installed building section 20 on the far end of the foundation beams 38.

The illustration in FIG. 1 better explains the fact that the crane 32 remains stationary at one end of the building site, to assemble the entire building. The dismantling of a transportable building is done in a similar manner, in a reverse order. As it may be appreciated, there is no need to clear a working space alongside the new building. The preferred building can be mounted in a narrow space between existing buildings, or between piles of rubble for example.

Figure 3:
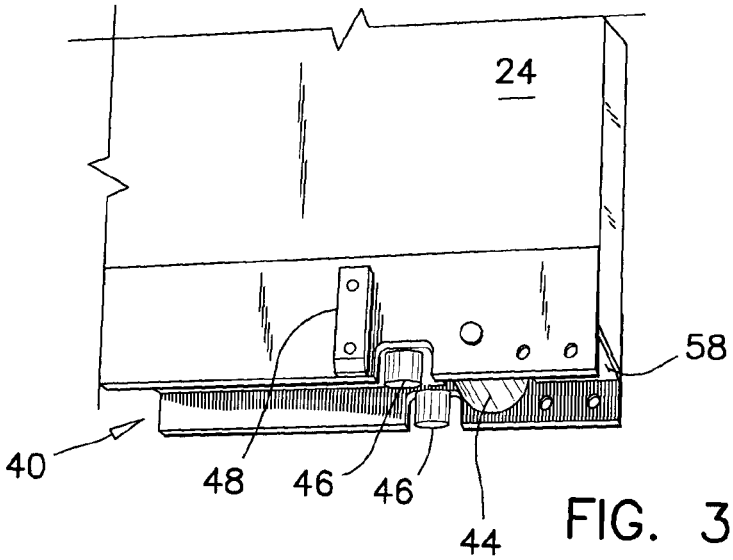
FIG. 3 is an enlarged view of the bottom end of the wall panel shown in FIG. 2 as seen in detail circle 3 in FIG. 2.
Figure 4:
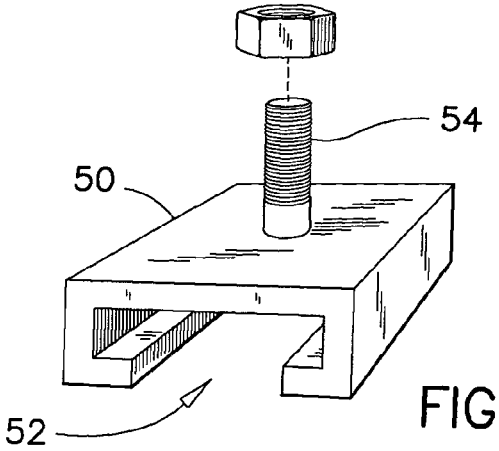
FIG. 4 is a perspective view of the skate clamp as seen at the centre of the bottom edge of the wall panel in FIG. 2.

Referring now to FIGS. 2, 3 and 4, further details about each wall panel 24 will be described. The bottom edge of each wall panel 24 has a channel 40 formed thereunder. The wheels 34 mentioned before are temporary mounted inside this channel 40 by means of bolts or pins 42 through holes in that channel 40 for example. These wheels 34 are removed as soon as a building section 20 is deployed and ready for placement on the foundation beams 38. A same set of four wheels 34 is used to deploy all the sections 20 required in the preferred transportable building.

The channel 40 has a support roller 44 mounted therein at each end thereof, and a pair of guide rollers 46 mounted near each support roller 44. The guide rollers 46 are spaced apart a "rail width" as it will be explained later. Guide blocks 48 are provided outside the channel 40 near the end of the channel 40 and on both sides of each wall panel 24. The function of these guide blocks 48 which will also be described later.

The channel 40 has a skate clamp 50 mounted therein near the centre of the wall panel 24. This skate clamp 50 is better illustrated in the perspective end view in FIG. 4. The skate clamp 50 consists of a metal block that has a T-shaped slot 52 formed therein along a length thereof. The dimension of this T-slot 52 is a sliding fit over a T-shaped rail formed on the top portion of the aforesaid foundation beams 38.

The skate clamp 50 also has a bolt 54 extending from its upper surface. The bolt 54 is made to extend into a framing member 58 inside the channel 40. This bolt 54 is used for mounting the skate clamp 50 to the lower portion of a wall panel 24. A slot 56 is provided in the inside surface of each wall panel 24, above the aforesaid framing member 58. The purpose of this slot 56 is to facilitate the tightening of the skate clamp 50 against the framing member 58 and for pulling and securing each wall panel 24 to one of the foundation beams 38. A partial view of one of the framing members 58 is illustrated in FIGS. 2, 3 and 5.

Figure 5:
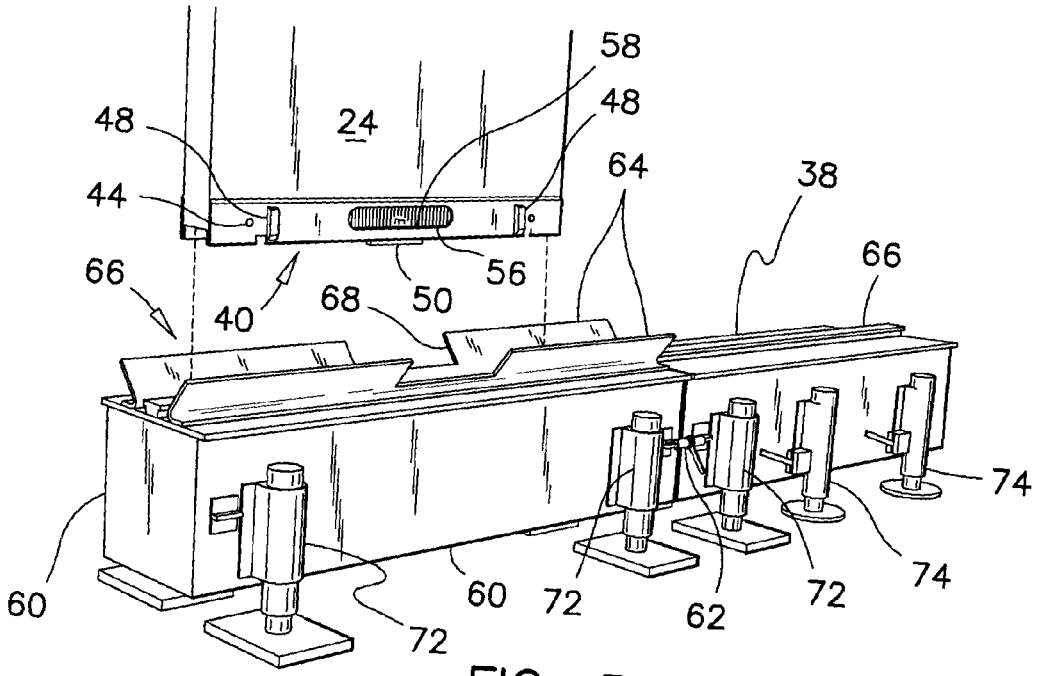
FIG. 5 is an enlarged view of a receiving end on the foundation beam included in the transportable building according to the preferred embodiment, as can be seen in detail circle 5 in FIG. 1.
Figure 6:
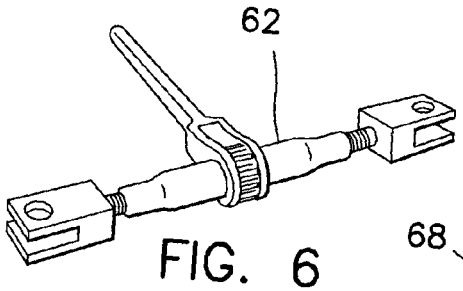
FIG. 6 is a perspective view of a tightener that is used to pull and to retain building sections together.
Figure 7:
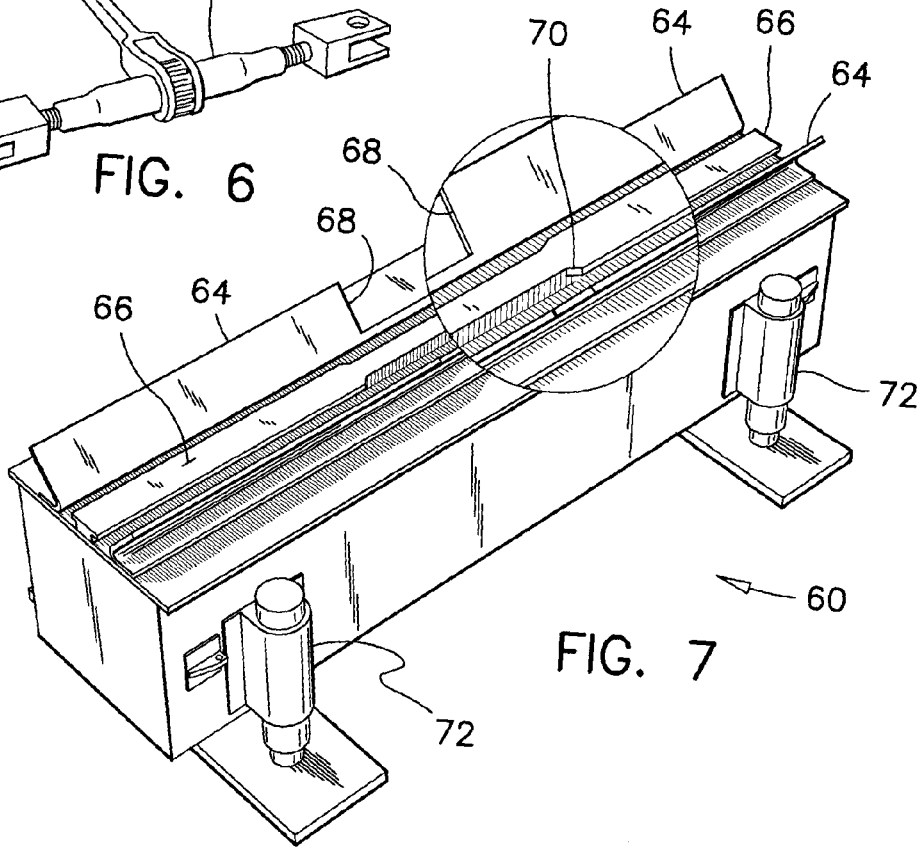
FIG. 7 is an enlarged perspective top, end and side view with a magnified portion of a receiving end that is attached to the end of a foundation beam in the transportable building according to the preferred embodiment.

Referring now to FIGS. 5-7, each foundation beam 38 has a receiving end 60. This receiving end 60 is attached to a main foundation beam 38 by tighteners 62 such as the one illustrated in FIG. 6. The receiving end 60 is used for receiving and for aligning each wall panel 24 onto one of the foundation beams 38. After a building section 20 has been aligned and set over the foundation beams 38, that building section 20 is moved along the foundation beams 38 and is secured to the foundation beams 38 against other building sections 20 already mounted to the foundation beams 38.

When a building is completely assembled, the receiving ends 60 can be removed from the foundation beams 38 and used to assemble another transportable building at another building site.

Each receiving end 60 has a pair of inclined side plates 64 defining a V-shaped trough for receiving and for guiding each wall panel 24 onto a T-shaped rail 66. Notches 68 are provided in the inclined plates 64 to facilitate the guiding and the engagement of the skate clamp 50 of each wall panel 24 onto a T-shaped rail 66.

As it will be understood, the guide blocks 48 on each side of a wall panel 24 help to guide each wall panel 24 between the inclined plates 64 to align the support rollers 44 over the T-shaped rail 66, and to align the guide rollers 46 on both sides of the T-shaped rail 66. As mentioned before, the guide rollers 46 are spaced-apart a "rail width" to guide each wall panel 24 precisely along the T-shaped rail 66.

The T-shaped rail 66 has its flanges 70 removed in a section between the notches 68 in the inclined plates 64, such that the T-shaped slot of the skate clamp 50 can be easily engaged onto the T-shaped rail 66.

When a building section 20 has its two skate clamps 50 engaged with the T-shaped rails 66 of both foundation beams 38, that building section 20 is rolled along the foundation beams 38 with its skate clamps 50 in a free sliding mode. That building section 20 is rolled along the foundation beams 38, until it can be clamped to other building sections 20 already positioned on the foundation beams 38.

Clamping of sections 20 together is done using the previously mentioned tighteners 62 or similar tools. Clamping of each building section 20 to the foundation beams 38 is done by tightening the nuts on bolts 54 of the skate clamps 50. The tightening of the nuts on bolts 54 on opposite skate clamps 50 in one building section 20 pulls that building section 20 tight against the foundation beams 38. The entire building becomes a single shell capable of resisting substantial wind loads.

Each receiving end 60 is supported on the ground by four workable jacks 72 that are mounted to the sides thereof. Similarly, each foundation beam 38 may be made in segments. These segments are held to each other by tighteners 62 or similar tools. Each segment or the entire foundation beam 38 is also levelled by four workable jacks 72. Preferably these workable jacks 72 are hydraulic jacks.

Figure 8:
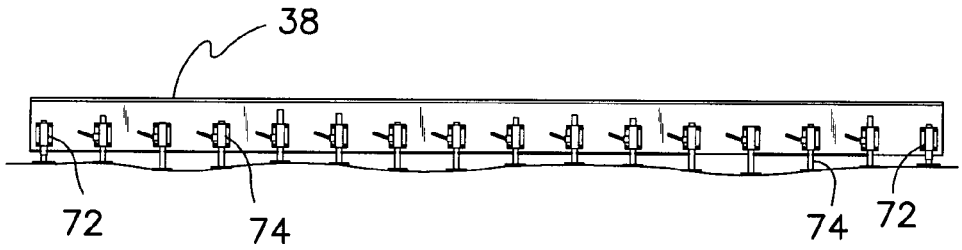
FIG. 8 is a elevation view of a foundation beam that is included in the transportable building according to the preferred embodiment.

Referring now to FIG. 8, a segment of a foundation beam 38 is illustrated therein. Each foundation beam 38 or each segment of a foundation beam 38 has two workable jacks 72 at each end, and a series of self-adjusting jacks 74 mounted at spaced intervals there along, on both sides thereof.

During an installation of the preferred transportable building, the workable jacks 72 are used to level each foundation beam 38 or each beam segment. Then the self-adjusting jacks 74 are released and are caused to latch when their bases touch the ground surface. Because of these self-adjusting jacks 74, the ground surface on the building site does not need to be levelled with precision. The self adjusting characteristic of the self-adjusting jacks 74 ensures that the foundation beams 38 provide a good support for the preferred transportable building, despite an irregular soil surface.

Figure 9:
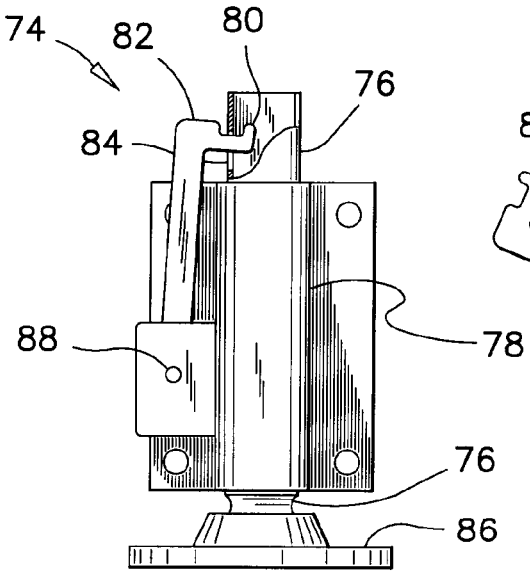
FIG. 9 illustrates a front elevation view of a self-adjusting levelling jack on the preferred foundation beams, as illustrated in FIG. 8, shown in a stowed position.
Figure 10:
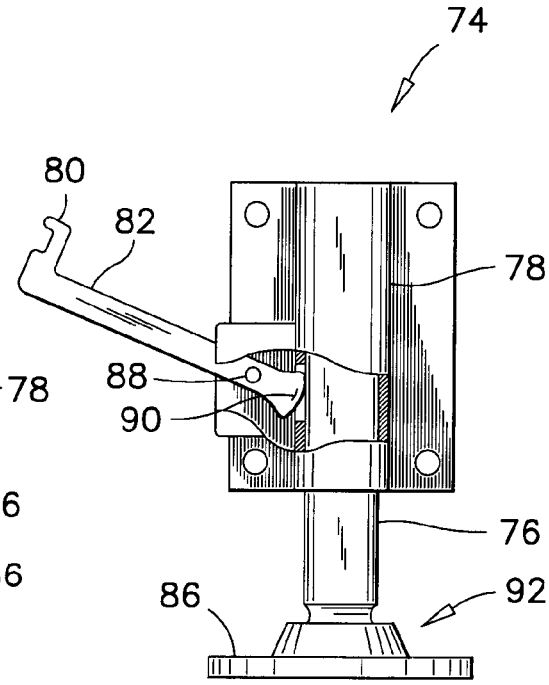
FIG. 10 illustrates a front elevation view with a cut-away portion of the self-adjusting levelling jack in FIG. 9, shown in a deployed position.

One of the self-adjusting jacks 74 is better illustrated in FIGS. 9 and 10. The self-adjusting jack 74 has a jack leg 76 sliding inside a hollow casing 78. The casing 78 is bolted or otherwise fastened to the side of a foundation beam 38. In a stowed mode, the leg 76 of the jack 74 is retained in its upper position by the engagement of a hook 80 on a lever 82. The hook 80 is inserted into a mating hole 84 in the upper end of the jack leg 76. The lever 82 is pivoted to the casing 78 of the jack. In use, the foot plate 86 of the jack 74 is raised slightly to disengage the hook 80 from the hole 84, and the leg 76 of the jack is allowed to slide in its casing 78 down to the ground. The lever 82 is also allowed to pivot downward on its pivot 88. The lower end of the lever 82 has a cam 90 formed thereon. In use, the cam 90 acts against the side of the leg 76 to prevent the leg from bouncing back upward when the leg is dropped to the ground. The cam 90 retains the jack leg 76 in its lowermost position. The action of the cam 90 against the jack leg 76 provides the self-adjusting feature of this jack 74.

When the foundation beams 38 are set on level, using the workable jacks 72 at both ends, all the self-adjusting jacks 74 are released in succession to secure the foundation beams 38 to that level. As it may be understood, the self-adjusting jacks 74 do not require an even ground surface to retain the foundation beams 38 to a level alignment. The jack legs 76 slide down until they encounter the ground surface and then the cams 90 prevent the jack legs 76 from moving away from this ground surface. Each self-adjusting jack 74 preferably has a ball joint 92 formed between the jack leg 76 and the foot plate 86, so that it can better adjust to uneven ground surfaces.

Figure 11:
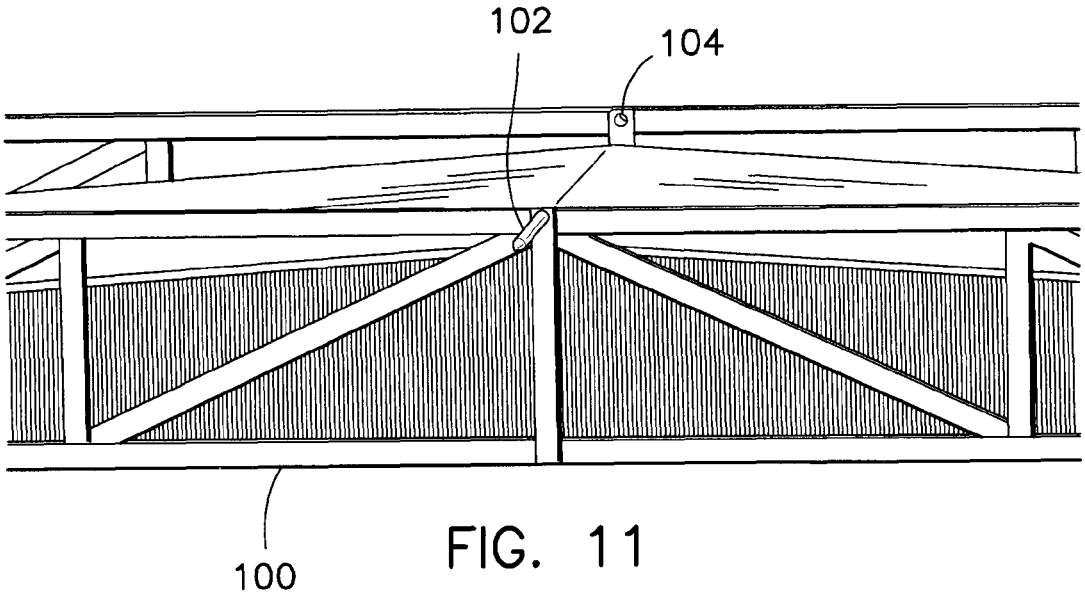
FIG. 11 is an enlarged view of the roof trusses on one building section, showing an alignment pin mounted on that section, as can be seen in detail circle 11 in FIG. 1.

Referring now to FIG. 11, another alignment feature will be described. This illustration shows a roof truss 100 on one of the building sections 20. A centering pin 102 is preferably provided on one side of the building section 20. A mating hole 104 is preferably provided on the other side of the section 20. During assembly of the building sections 20 along the foundation beams 38, the pin 102 on one building section 20 is made to align into the hole 104 of the adjacent building section 20 to ensure a proper alignment of the building sections 20 relative to each other.

Figure 12:
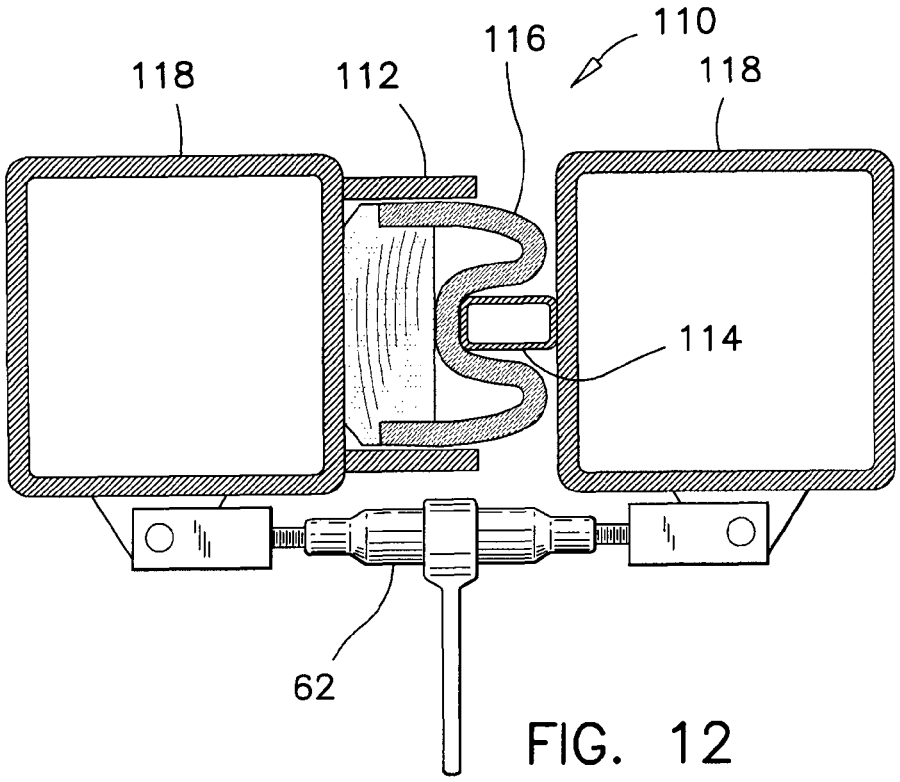
FIG. 12 illustrates a cross-section view of a typical deformable joint along the edges of adjacent building sections in the transportable building according to the preferred embodiment.

A proper alignment of the building sections 20 as mentioned above is preferred to ensure a proper alignment of sealing joints 110 between the edges of neighbouring building sections 20. As it may be understood from the illustration in FIG. 12, the deformable sealing joint 110 is made of a side channel 112 mounted to the framing member along one edge of a building section 20, and a side lip 114 mounted to the framing member on the opposite edge of the building section 20. The side channel 112 has a deformable hollow rubber bumper 116 mounted therein. In use, the side lip 114 pushes the hollow bumper 116 inside the side channel 112 to create a sealed joint along adjacent building sections 20. Tighteners 62 as illustrated in FIG. 6 are used to pull and to retain the frame members 118 of adjacent building sections 20 together.

This deformable joint 110 is preferably used along the side edges and the roof edges between adjacent building sections 20.

The use of tighteners 62, foldable building sections 20 and foundation beams 38 makes it relatively easy to assemble large buildings in a relatively short time. As an example, a transportable building according to the preferred embodiment having dimensions of 60 feet wide by 28 feet high and 100 feet long, was assembled in 4 hours by 6 men and a 45 ton crane. These transportable buildings are also relatively easy to disassemble and to transport away when the life of a project has ended.

What is claimed is:

1. A transportable building comprising side-by-side building sections and parallel foundation beams mounted for supporting said building sections on a ground surface;

each of said building sections having a roof and opposite vertical wall panels;

each of said vertical wall panels having a skate clamp mounted thereon;

said skate clamp having a sliding surface for sliding engagement with one of said foundation beams and a clamping surface;

an adjustable mechanism associated with said clamping surface for selectively pulling said clamping surface and said vertical wall panel against said foundation beam, for forcefully retaining said vertical wall panel to said foundation beam;

said foundation beam having a T-shaped rail mounted thereon;

said skate clamp having a T-shaped slot formed therein, and said T-shaped slot being engagedly slidable onto said T-shaped rail;

each of said foundation beams comprising a receiving end, and said receiving end having a V-shaped trough on an upper side thereof for receiving a bottom edge of one of said vertical wall panels, and said T-shaped rail having opposite flange portions thereof removed along a segment of said V-shaped trough for engagement of said T-shaped slot onto said T-shaped rail.

2. The transportable building as claimed in claim 1, wherein each of said vertical wall panels also has support rolls mounted thereon for rolling engagement onto one of said foundation beams.

3. The transportable building as claimed in claim 2 wherein each of said vertical wall panels has a channel under a lower edge thereof, and said support rolls and said skate clamp being mounted inside said channel.

4. The transportable building as claimed in claim 3, further including guide rollers mounted in said channel near said support rolls for guiding engagement to said foundation beams.

5. The transportable building as claimed in claim 1, wherein each of said foundation beams has workable jacks at each end thereof, and a series of self-adjusting jacks spaced between said workable jacks.

6. The transportable building as claimed in claim 1, wherein each of said foundation beams has a receiving end mounted thereto, and said receiving end has a pair of oppositely inclined plates forming a V-shaped trough on an upper surface thereof.

7. The transportable building as claimed in claim 6, wherein each of said vertical wall panel has guide blocks on outside surfaces thereof for guiding a bottom edge of said vertical wall panel inside said V-shaped trough.

8. The transportable building as claimed in claim 1, wherein said side-by-side sections having deformable joints there between.

9. The transportable building as claimed in claim 8 further comprising tighteners mounted to said side-by-side sections for tightening said deformable joints.

10. A foundation beam for supporting a side of a transportable building, said foundation beam having a T-shaped rail mounted thereon said T-shaped rail having a top surface and side surfaces bordering said top surface;

said side of said transportable building having support rollers for supporting said side of said transportable building over said top surface of said T-shaped rail, guide rollers for guiding said side of said transportable building against said side surfaces of said T-shaped rail, and a skate clamp having a T-shaped slot formed therein for clamping engagement with said T-shaped rail; and further having a removable receiving end attached thereto and a V-shaped trough on an upper surface of said receiving end, said V-shaped trough comprising two side plates inclined toward each other at a lower end thereof and toward said T-shaped rail, for aligning said side of said transportable building onto said T-shaped rail; said T-shaped rail having opposite flange portions thereof removed along a segment of said V-shaped trough for engagement of said T-shaped slot onto said T-shaped rail.

11. The foundation beam as claimed in claim 10, also having workable jacks at each end thereof and a series of self-adjusting jacks mounted thereto between said workable jacks.

12. The foundation beam as claimed in claim 11, wherein each of said self-adjusting jacks have a support plate and a ball joint on a lower end thereof for supporting said jack on an uneven ground surface.

13. The foundation beam as claimed in claim 10, comprising several beam segments, and tighteners removably affixed to said beam segments for removably retaining said beam segments to each other.

14. A pair of foundation beams for assembling and supporting a transportable building on an uneven ground surface, said foundation beams having workable jacks at each end thereof and a series of self-adjusting jacks mounted thereto between said workable jacks, each of said self-adjusting jacks has a cam lever mounted thereto and acting against a leg thereof for allowing a free movement of said leg in a downward direction, and for preventing a movement of said leg in an upward direction; each of said foundation beams also having a removable receiving end and a V-shaped trough on an upper surface of said receiving end, for aligning sections of said transportable building thereon.

15. The pair of foundation beams as claimed in claim 14, wherein each of said self-adjusting jacks has a support plate and a ball joint on a lower end thereof.

* * * * *